United States Patent [19]

Won et al.

[11] Patent Number: 5,014,174

[45] Date of Patent: May 7, 1991

[54] REFLECTION SHEET FOR LIGHTING OR COLOR-LIGHTING

[75] Inventors: Joung H. Won, 462-14 Cahl Hyun Dong, Eun pyung Ku; Eun Y. Kim, both of Seoul, Rep. of Korea

[73] Assignee: Joung H. Won, Seoul, Rep. of Korea

[21] Appl. No.: 306,710

[22] Filed: Feb. 6, 1989

[30] Foreign Application Priority Data

Feb. 6, 1988 [KR] Rep. of Korea ..... 1115

[51] Int. Cl.[5] ..... F21V 7/12; F21V 13/04

[52] U.S. Cl. ..... 362/309; 362/327; 362/348; 350/1.6

[58] Field of Search ..... 362/296, 341, 348, 308, 362/309, 260, 217, 327; 350/1.6

[56] References Cited

U.S. PATENT DOCUMENTS

| | | | |
|---|---|---|---|
| 1,143,650 | 6/1915 | Scribner | 362/348 |
| 1,517,563 | 12/1924 | Lovell | 362/348 |
| 1,590,130 | 6/1926 | Sturgeon, Jr. | 362/348 |
| 1,900,551 | 3/1933 | Guth | 362/348 |
| 2,115,290 | 4/1938 | Solomon | 362/348 |
| 4,799,137 | 1/1989 | Aho | 362/309 |
| 4,874,228 | 10/1989 | Aho et al. | 362/309 |

FOREIGN PATENT DOCUMENTS

| | | | |
|---|---|---|---|
| 2602303 | 7/1976 | Fed. Rep. of Germany | 362/341 |
| 56-114210 | 9/1981 | Japan . | |
| 59-76011 | 5/1984 | Japan . | |
| 61-25128 | 7/1986 | Japan . | |
| 85878 | 6/1985 | Rep. of Korea . | |
| 609272 | 9/1948 | United Kingdom | 362/348 |
| 1011778 | 12/1965 | United Kingdom | 362/341 |
| 2061480 | 5/1981 | United Kingdom | 362/341 |

*Primary Examiner*—Ira S. Lazarus
*Assistant Examiner*—Richard R. Cole
*Attorney, Agent, or Firm*—Fleit, Jacobson, Cohn, Price, Holman & Stern

[57] ABSTRACT

A light reflection sheet is provided incorporating a transparent polyester resin film having an aluminum coating or film disposed on one side and over which a transparent polyester resin film is applied. The side of the first mentioned resin film remote from the aluminum coating is exposed and provided with minute, uneven random reflection permeable faces to reduce dazzling and temporal eyesight problems resulting from direct reflection.

3 Claims, 3 Drawing Sheets

REFLECTION SHEET FOR LIGHTING OR COLOR-LIGHTING

BACKGROUND OF THE INVENTION

1. Field of the Invention

This invention relates to a reflection sheet for a hot and cold cathod electric discharging lamp and more particularly to a reflection sheet to provide soft and uniform white or color-lighting by providing a reflective layer by vacuum evaporation of aluminum (including metal materials and heatproof shade materials).

2. Description of the Prior Art

In prior art, hot wires are used in making the reflection sheet in order to avoid heat deformation. At present, a fluorescent lamp attaches importance to lighting effect, namely, reflection effect, so that, a paint layer is formed by staining process. However, the reflection function produced by the above is reduced in proportion to the term of use because of the forming of hetergenous substances on the paint reflection layer and the corrosion of the paint reflecting layer.

In one type of conventional prior art, a light reflection aluminum vaporized layer is formed on the reflection sheet, and then the reflection layer is protected by a transparent acrylic film.

Further, in another conventional art, an aluminum vaporized layer is formed on transparent acrylic film, and then a shellac coating layer and a paint protection layer are provided on the aluminum vaporized layer for the purpose of increasing a reflection effect. However, the above methods result in difficult problems such as inefficient production, dazzling resulting from direct reflection and temporal eyesight problems.

Yet another prior art disclosed in Japanese utility model publication No. 61-25128 shows that an aluminum coating on a synthetic resin layer are formed on the surface of a synthetic board. However, the above Japanese disclosure is designed to increase reflection effect by the aluminum reflection layer.

Still other prior art disclosed in Japanese laid-open utility model publication No. 59-76011 shows that a reflection tube consisting of a film having a light reflection layer and a transparent resin film is disposed around a fluorescent lamp. However, only the aluminum vaporized reflection layer increases the reflection effect and the lights of the said Japanese utility model have no side reflection effects and produce dazzling.

SUMMARY OF THE INVENTION

Hence, an object of the present invention is to provide a reflection sheet for soft and uniform lighting or color-lighting which does not dazzle eyes.

In particular, it is desired to provide reflection sheet having none of the above defects. Further, in the present invention, only the aluminum reflection layer (vaporized layer) which produces excellent reflection effect is adapted, and the reflection sheet for lighting or color-lighting according to the present invention can be readily produced. Furthermore, the reflector reflection sheet of the present invention can increase effects of light-reflection energy by random reflection and random re-reflection and produces soft and uniform reflection lights without dazzling and by rasing reflection effects.

Further, in the present invention, a high purity aluminum reflection layer is utilized and a curved surface-reflection is applied to the reflection sheet of the present invention.

In the present invention, a high purity aluminum reflection layer is formed between two transparent films providing an elastic plasticity and a heat-proof shading property and to provide a curved reflection surface without any difficulty and any further process.

In the present invention, a synthetic transparent PET (polyester) resin having a high transparency, elastic plasticity and relatively high melting point is utilized but other possible materials having better transparency, elasticity, plasticity and melting point will be used for the reflection sheet of the present invention in the future.

Also, another object of the present invention is to provide a reflection sheet for soft and uniform lighting or color-lighting in which an elastic plastic transparent film (polyester) is used, and an aluminum reflection layer is formed, by using an aluminum vacuum vaporizing process (high purity aluminum is used), onto the face of another transparent film and then the two films are adhered to each other by using a polyurethane adhesive and the two adhered films are curved to have a curved reflection face and then minute uneven permeable faces are formed on the reflection face of the reflection sheet as hereinbefore set forth.

Other objects, advantages and novel features of the present invention will become apparent from the following detailed description of the invention when considered in conjunction with the accompanying drawings.

DETAILED DESCRIPTION OF PREFERRED EMBODIMENTS

Referring first to FIG. 6, the synthetic resin film according to the present invention is produced by conventional method of film production.

In the production of the reflection sheet, an elastic plastic transparent film is first prepared, and a transparent film having aluminum reflection layer made by a high purity aluminum vacuum vaporizing is prepared and then the two films are physically adhered to each other by using a polyurethane adhesive and then formed to be a reflection sheet.

Thereafter, minute uneven random reflection permeable faces are formed on the lower film of the above mentioned two adhered films in order to increase light reflection energy for the purpose of soft and uniform lighting (white lighting or color-lighting) and for the purpose of obtaining high lighting. Such minute uneven reflection faces may be formed by a conventional sanding process.

In other examples of present invention, a color layer can be formed on the surface of the lighting reflection sheet made according to the present invention by coating process or by adhering a colored polyester transparent film on the surface of the same.

The thickness of the reflection sheet according to the present can be easily selectively determined for use, and the reflection sheet according to the present invention is mainly used by curving said plate as shown in FIG. 6.

Figure 1:
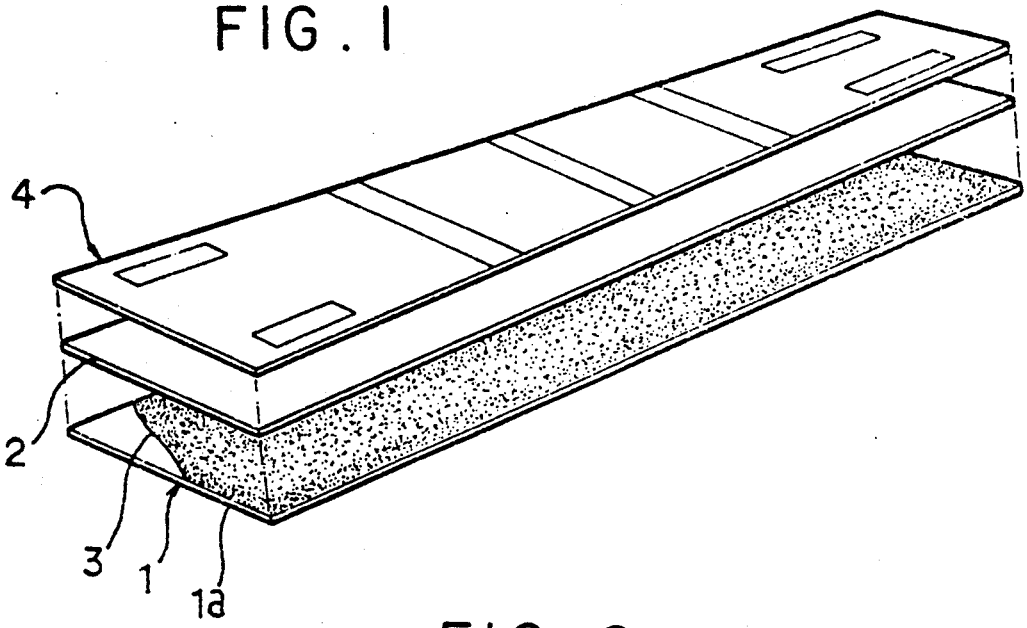
FIG. 1 is an exploded perspective view of the reflection sheet according to the present invention.
Figure 2:
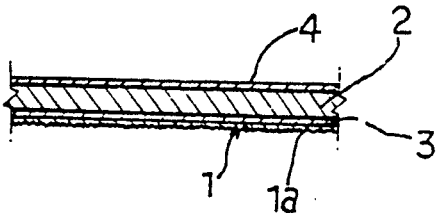
FIG. 2 is an enlarged vertical sectional view of FIG. 1.

Now, with reference to FIGS. 1 and 2, there is shown in a reflection sheet in accordance with one embodiment of the present invention, as shown.

FIG. 1 is a perspective view showing a separated reflection sheet (unadhered), and an aluminum vacuum vaporized layer or an aluminum foil paper 3 is lain between two transparent polyester resin film layers 1 and 2 to form a high purity aluminum reflection layer 3.

The above transparent polyester film (reflection permeable layer of light) has a high degree of transparency, and it was found that 58 micron is better than 38 micron in permeable effects by inventor's test.

To one face of the transparent polyester resin film 1 a high purity aluminum reflection layer 3 is formed by a aluminum vacuum vaporizing process, or a high purity aluminum foil is adhered to the film 1, and then a transparent polyester resin film 4 is adhered to the face of the transparent polyester resin film 2 to reinforce the material sheet.

And minute uneven random reflection permeable faces 1*a* are formed on the surface of the transparent polyester resin film 1 by conventional sanding process to be prevented from direct reflections of lights.

Figure 3:
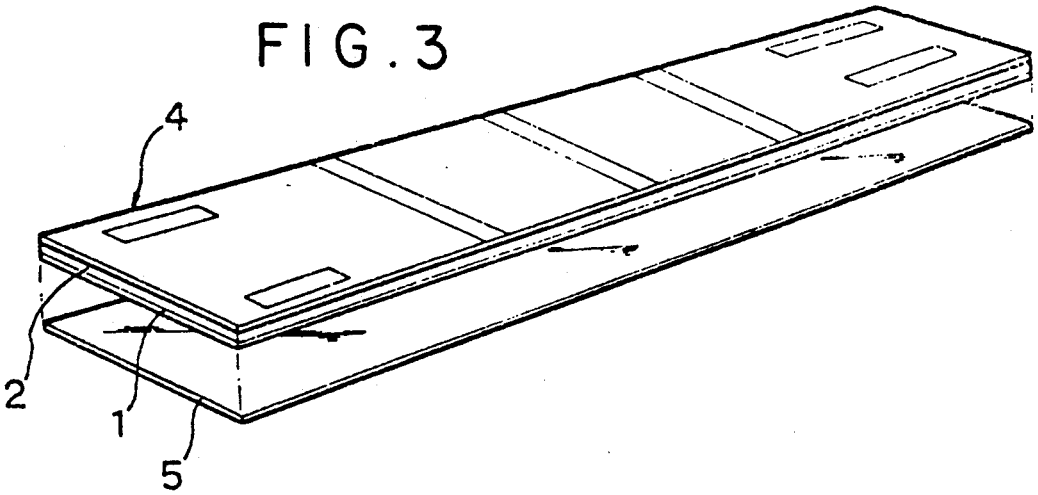
FIG. 3 is an exploded perspective view of another example.
Figure 4:
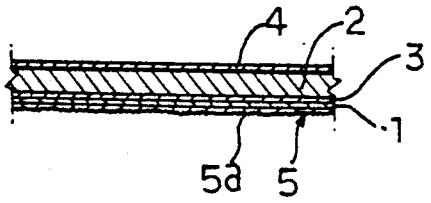
FIG. 4 is an enlarged vertical sectional view of FIG. 3, FIG. 5A, FIG. 5B and FIG. 5C are enlarged sectional views of other examples.

As shown in FIGS. 3 to 4 a colored transparent polyester resin film 5 made by means of color-coating or mixing paints is adhered before forming two or three layers of reflection permeable face 1*a* for making a color-reflection sheet and then random reflection permeable faces 5*a* are formed by conventional sanding process.

Figure 5A:
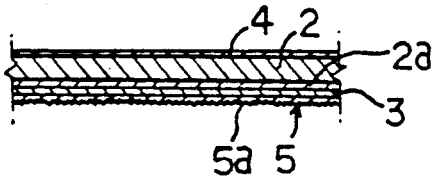
Figure 5B:
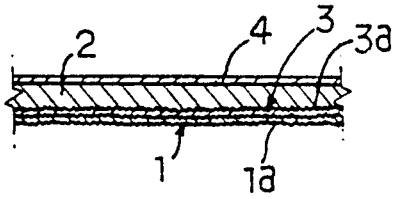
Figure 5C:
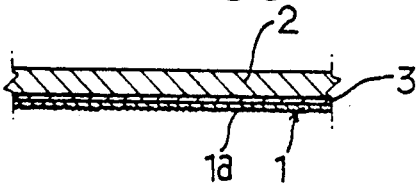

FIG. 5 shows other examples. FIG. 5A shown an enlarged sectional view of a reflection-sheet of the present invention having a heatproof shading layer 2*a*. In the example, the above colored transparent layer is not used but the colored transparent polyester resin film 1 in order to decrease number of film layers. And FIG. 5B shows an other example, in this example, the aluminum reflection layer 3 is formed in a wave-shape to be as random refection faces. And in FIG. 5C, the transparent polyester resin film layer 4 is not used.

Figure 6A:
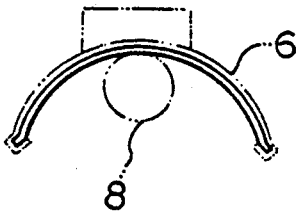
FIG. 6A, FIG. 6B and FIG. 6C are sectional views showing reflection shades made by the reflection sheet according to the present invention.
Figure 6B:
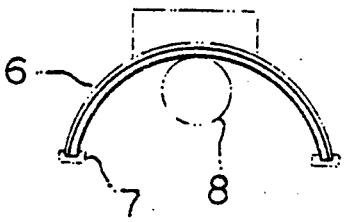

The reflection sheet according to the present invention has a elastic plasticity. As shown in FIG. 6A and FIG. 6B, the reflection sheet is cut in length of a fluorescent lamp and the width of the above cut reflection sheet is selectively decided as required and then curved (bent) to the be in a desired shape by proper shapers 6 and 7 for a fluorescent lamp 8.

Figure 6C:
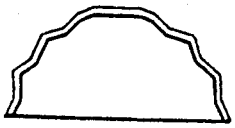

As shown in FIG. 6C, the reflection sheet can be made as a reflection shade which can be prevented from transformation by means of making the reflection sheet at a temperature of heat deformation or by a vacuum formation process because of its elastic plasticity.

Figure 7:
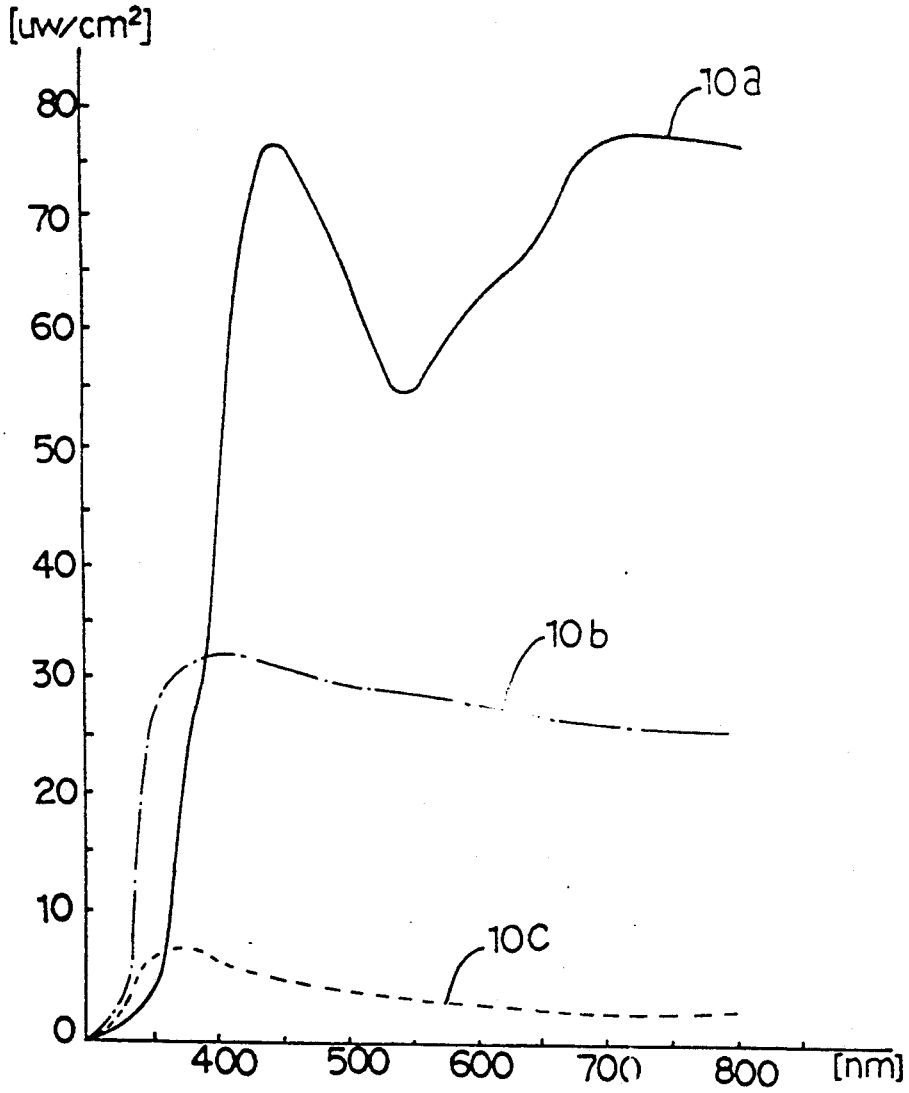
FIG. 7 is a table of light reflection energies to each wavelength of a reflection shade.

As hereinbefore mentioned, the reflection sheet of the present invention incorporates a light diffusion reflection face because of the minute uneven random reflection permeable faces 1*a* and 5*a* which prevent light from direct reflection. The light passing through the random reflection permeable faces 1*a* and 5*a* is re-reflected by the aluminum reflection layer 3 passes through the transparent polyester resin film layer 1 in random directions so that the light reflection sheet of the present invention produces only random reflections which do not make dazzling but afford soft and uniform light. This function is proven by the test comparison table of light reflection of each wave length of reflection shade as shown in FIG. 7, thus, the reflection sheet of the present invention has reflection effects providing high visual sensitiveness.

The reflection sheet is extremely applicable for CRT (Cathode-ray tube).

In prior arts of acrylic reflection sheet and glass reflection, the reflection effect is high but the dazzling phenomenon is increased and eyes get tired. However, the reflection sheet of the present invention does not produce any dazzling phenomenon which makes eyes get tired. Further, the size of the minute uneven permeable faces can be easily determined by conventional sanding process according to the purpose of use and to the thickness of the material.

In the case of enhancing only the lighting-degree in a colored reflection sheet of the present invention, the reflection permeable film layer is formed by colored polyester resin film and conventional sanding process is not carried out. However, the light reflected from a white lamp is changed into colored lights. Accordingly, the reflection sheet of the present invention provides reflected light which does not dazzle. Further, production costs are lower in comparison to conventional sheets or plates.

As hereinbefore mentioned, in the present invention, the transparent polyester resin film is used as the material to which the aluminum reflection layer is added for the purposes of giving heat-proof shading, elastic plasticity, diffractive function of reflection light and function of colored reflection lighting as well as raising of utility value. In addition, because of the use of polyester resin film, in comparison with a conventional reflector consisting of glass, the reflector of this invention is safer than a conventional reflector. Further, the reflection sheet is free from oxidation even if used for ships so that the life of the reflector of the present invention is long because of the corrosion-proof properties thereof.

Furthermore, the reflection sheet of the present invention can be easily produced by successive economic production processes in comparison with conventional production processes, and the formation of the reflector of the present invention can be easily carried out by virtue of the materials used in the present invention.

What is claimed is:

1. A reflection sheet for lighting or color-lighting and capable of being flexed into desired reflection body shape, said sheet including a first polyester resin film, an aluminum coating disposed over one side of said film and having an exposed side remote from said first film, a second transparent polyester resin film overlying and adhered to the exposed side of said aluminum coating, the side of said first polyester film remote from said coating having minute, uneven random reflection permeable faces thereon for reduction of dazzling and temporal eyesight problems resulting from direct light reflection.

2. The reflection sheet of claim 1 wherein said coating comprises a vacuum vaporized layer of aluminum.

3. The reflection sheet of claim 5 wherein said coating comprises an aluminum foil.

* * * * *